US008297073B2

(12) United States Patent
Kawano et al.

(10) Patent No.: US 8,297,073 B2
(45) Date of Patent: Oct. 30, 2012

(54) HEAT SOURCE UNIT AND REFRIGERATION SYSTEM

(75) Inventors: Satoshi Kawano, Osaka (JP); Shinya Matsuoka, Osaka (JP); Masahiro Oka, Osaka (JP); Kazuhide Mizutani, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 663 days.

(21) Appl. No.: 12/525,203

(22) PCT Filed: Jan. 30, 2008

(86) PCT No.: PCT/JP2008/051384

§ 371 (c)(1),
(2), (4) Date: Jul. 30, 2009

(87) PCT Pub. No.: WO2008/093718

PCT Pub. Date: Aug. 7, 2008

(65) Prior Publication Data

US 2010/0089085 A1 Apr. 15, 2010

(30) Foreign Application Priority Data

Jan. 31, 2007 (JP) ..... 2007-020592

(51) Int. Cl.
*F25B 43/02* (2006.01)

(52) U.S. Cl. ..... 62/468

(58) Field of Classification Search ..... 62/468, 62/238.6, 470, 228.3, 513, 238.7, 324.1, 62/160, 509, 512, 129, 126
See application file for complete search history.

(56) References Cited

U.S. PATENT DOCUMENTS 5,526,649 A * 6/1996 Sada ..... 62/175
6,024,547 A * 2/2000 Nagae ..... 418/11
6,772,600 B2 * 8/2004 Hwang ..... 62/160
6,973,796 B2 * 12/2005 Park et al. ..... 62/160
(Continued)

FOREIGN PATENT DOCUMENTS

CN 2682346 Y 3/2005
(Continued)

OTHER PUBLICATIONS

Translation of JP 2004-061023 to Chin Kumushu.*

*Primary Examiner* — Mohammad Ali
(74) *Attorney, Agent, or Firm* — Birch, Stewart, Kolasch & Birch, LLP.

(57) ABSTRACT

An outdoor unit (20) including a compressor (21) and an outdoor heat exchanger (22) and an indoor unit (30) including an indoor heat exchanger (31) are provided. The outdoor unit (20) and the indoor unit (30) constitute a main circuit (43) of a refrigerant circuit (40). A sub-circuit (70) whose one end is connected to a liquid line (4*a*) of the main circuit (43) and another end is connected to a low-pressure gas line (4*b*) of the main circuit (43), and which stores refrigerant in the main circuit (43) is also provided. The sub-circuit (70) is located on a sub-passageway (71), and includes: a refrigerant regulator (72) for storing refrigerant in the main circuit (43); and a switch mechanism (73) for establishing and blocking communication between the refrigerant regulator (72) and each of the liquid line (4*a*) and the low-pressure gas line (4*b*). When the amount of refrigerant in the main circuit (43) is excessive, redundant refrigerant in the main circuit (43) is stored in the refrigerant regulator (72).

4 Claims, 3 Drawing Sheets

U.S. PATENT DOCUMENTS

| | | | | |
|---|---|---|---|---|
| 8,020,402 | B2 * | 9/2011 | Pham et al. | 62/324.1 |
| 2003/0230106 | A1 | 12/2003 | Takano et al. | |
| 2005/0086960 | A1 * | 4/2005 | Yokozeki et al. | 62/228.3 |
| 2005/0115271 | A1 * | 6/2005 | Takegami et al. | 62/498 |
| 2006/0005558 | A1 * | 1/2006 | Otake et al. | 62/260 |
| 2006/0090486 | A1 * | 5/2006 | Heuk Choi et al. | 62/160 |
| 2006/0179873 | A1 * | 8/2006 | Yoshimi et al. | 62/474 |
| 2006/0185376 | A1 * | 8/2006 | Yoshimi et al. | 62/228.1 |
| 2006/0191286 | A1 * | 8/2006 | Park et al. | 62/434 |
| 2006/0266057 | A1 * | 11/2006 | Yakumaru et al. | 62/160 |
| 2009/0113907 | A1 | 5/2009 | Sakitani et al. | |

FOREIGN PATENT DOCUMENTS

| | | | |
|---|---|---|---|
| JP | 59-175961 | U | 11/1984 |
| JP | 5-79357 | U | 10/1993 |
| JP | 10-47799 | A | 2/1998 |
| JP | 2000-292037 | A | 10/2000 |
| JP | 2004-17681 | A | 1/2004 |
| JP | 2004-61023 | A | 2/2004 |
| JP | 2006-78087 | A | 3/2006 |
| JP | 2006-214610 | A | 8/2006 |
| JP | 2006-292214 | A | 10/2006 |

* cited by examiner

HEAT SOURCE UNIT AND REFRIGERATION SYSTEM

TECHNICAL FIELD

The present invention relates to heat source units and refrigeration systems, and particularly relates to measures for adjusting refrigerant in refrigerant circuits.

BACKGROUND ART

As described in Patent Document 1, some conventional air conditioners include refrigerant circuits in each of which a compressor, an outdoor heat exchanger, an outdoor expansion valve, an indoor expansion valve, and an indoor heat exchanger are connected to each other in series. In such a refrigerant circuit, a receiver for storing refrigerant is provided between the outdoor expansion valve and the indoor expansion valve.

On the other hand, as described in Patent Document 2, some conventional air conditioners include refrigerant circuits in each of which a compressor, an outdoor heat exchanger, an expansion valve, an indoor heat exchanger are sequentially connected to each other. In such a refrigerant circuit, an accumulator for separating liquid refrigerant and gas refrigerant from each other is provided at the suction side of the compressor.

Patent Document 1: Japanese Laid-Open Patent Publication No. 2006-214610

Patent Document 2: Japanese Laid-Open Patent Publication No. 2006-78087

DISCLOSURE OF INVENTION

Problems that the Invention is to Solve

However, the conventional air conditioners of Patent Documents 1 and 2 pose a problem of heat loss because of the presence of the receiver or the accumulator in main circuits of the refrigerant circuits.

Specifically, in the air conditioner including the receiver in the main circuit of the refrigerant circuit, redundant liquid refrigerant accumulates during heating operation, and this liquid refrigerant dissipates heat into the outdoor air. In addition, the heat dissipation of liquid refrigerant which continuously circulates during heating operation causes the problem of considerable heat loss.

On the other hand, in the air conditioner including the accumulator in the main circuit of the refrigerant circuit, when redundant liquid refrigerant accumulates during cooling operation, this liquid refrigerant dissipates heat into the outdoor air because the temperature of the outdoor air is high. In addition, the heat dissipation of liquid refrigerant which continuously circulates during cooling operation causes the problem of considerable heat loss.

It is therefore an object of the present invention to reduce heat loss during refrigeration operation.

Means of Solving the Problems

According to the present invention, refrigerant is adjusted with a sub-circuit which is separated from a main circuit of a refrigerant circuit.

A first aspect of the present invention is directed to a heat source unit including: a compressor (21) to which a low-pressure gas line (4*b*) is connected; a heat-source side heat exchanger (22) whose one end communicates with the compressor (21) and another end is connected to a liquid line (4*a*); and a sub-circuit (70) whose one end is connected to the liquid line (4*a*) and another end is connected to the low-pressure gas line (4*b*). The compressor (21), the low-pressure gas line (4*b*), the heat-source side heat exchanger (22), and the liquid line (4*a*) constitute a portion of a main circuit (43) of a refrigerant circuit (40). The sub-circuit (70) is separated from the main circuit (43), and stores refrigerant in the main circuit (43).

In a second aspect of the present invention, in the heat source unit according to the first aspect, the sub-circuit (70) includes: a sub-passageway (71) whose one end is connected to the liquid line (4*a*) and another end is connected to the low-pressure gas line (4*b*); a refrigerant regulator (72) provided on the sub-passageway (71) and storing refrigerant in the main circuit (43); and a switch mechanism (73) configured to establish and block communication between the refrigerant regulator (72) and each of the liquid line (4*a*) and the low-pressure gas line (4*b*).

A third aspect of the present invention is directed to a refrigeration system including the heat source unit (20) according to the second aspect. In this refrigeration system, the main circuit (43) of the refrigerant circuit (40) is configured by connecting a utilization unit (30) including a utilization side heat exchanger (31) to the heat source unit (20), and the refrigeration system includes a refrigerant-amount controlling means (91) configured to control the switch mechanism (73) such that when an amount of refrigerant in the main circuit (43) is excessive, redundant refrigerant in the main circuit (43) is stored in the refrigerant regulator (72).

In a fourth aspect of the present invention, in the refrigeration system according to the third aspect, the refrigerant-amount controlling means (91) controls the switch mechanism (73) such that when the main circuit (43) is deficient in refrigerant, refrigerant in an amount corresponding to the deficiency is supplied from the refrigerant regulator (72) to the main circuit (43)

In a fifth aspect of the present invention, in the refrigeration system according to the third aspect, the refrigerant-amount controlling means (91) is configured to determine whether an amount of refrigerant in the main circuit (43) is excessive or not, based on a degree of supercooling in one of the heat-source side heat exchanger (22) and the utilization side heat exchanger (31) which serves as a condenser.

In a sixth aspect of the present invention, in the refrigeration system according to the fourth aspect, the refrigerant-amount controlling means (91) is configured to determine whether the main circuit (43) is deficient in refrigerant or not, based on a degree of supercooling in one of the heat-source side heat exchanger (22) and the utilization side heat exchanger (31) which serves as a condenser.

A seventh aspect of the present invention, the refrigeration system according to the third aspect, the refrigerant-amount controlling means (91) is configured to determine whether an amount of refrigerant in the main circuit (43) is excessive or not, based on a change in a pressure of refrigerant discharged from the compressor (21) after start-up.

In an eighth aspect of the present invention, the refrigeration system according to the second aspect further includes: an oil separator (60) provided at a discharge side of the compressor (21); an oil return passageway (61) for returning oil in the oil separator (60) to the compressor (21); and an oil introducing pipe (77) connecting the oil return passageway (61) and the refrigerant regulator (72) to each other, and capable of establishing and blocking communication with the oil introducing pipe (77).

In a ninth aspect of the present invention, the refrigeration system according to the third aspect further includes: an oil separator (60) provided at a discharge side of the compressor (21); an oil return passageway (61) for returning oil in the oil separator (60) to the compressor (21); and an oil introducing pipe (77) connecting the oil return passageway (61) and the refrigerant regulator (72) to each other, and capable of establishing and blocking communication with the oil introducing pipe (77).

<Functions>

In the first aspect of the present invention, when a large amount of refrigerant is contained in the main circuit (43), redundant refrigerant is recovered to the sub-circuit (70). Specifically, in the second aspect of the present invention, the switch mechanism (73) is switched to recover refrigerant in the main circuit (43) to the refrigerant regulator (72).

In particular, in the third aspect of the present invention, the refrigerant-amount controlling means (91) controls switching of the switch mechanism (73) to recover refrigerant in the main circuit (43) to the refrigerant regulator (72). On the other hand, in the fourth aspect of the present invention, when the main circuit (43) is deficient in refrigerant, the refrigerant-amount controlling means (91) controls switching of the switch mechanism (73) to supply refrigerant in an amount corresponding to the deficiency in the main circuit (43) from the refrigerant regulator (72) to the main circuit (43).

In the fifth aspect of the present invention, the refrigerant-amount controlling means (91) determines whether the amount of refrigerant in the main circuit (43) is excessive or not, based on the degree of supercooling in one of the heat-source side heat exchanger (22) and the utilization side heat exchanger (31) which serves as a condenser. In the sixth aspect of the present invention, the refrigerant-amount controlling means (91) determines whether the main circuit (43) is deficient in refrigerant or not, based on the degree of supercooling in one of the heat-source side heat exchanger (22) and the utilization side heat exchanger (31) which serves as a condenser.

In the seventh aspect of the present invention, the refrigerant-amount controlling means (91) determines whether the amount of refrigerant in the main circuit (43) is excessive or not, based on a change in the pressure of refrigerant discharged from the compressor (21) after start-up.

In the eighth and ninth aspects of the present invention, when the compressor (21) is filled with a large amount of lubricating oil, part of oil returning from the oil separator (60) to the compressor (21) through the oil return passageway (61) is recovered to the refrigerant regulator (72) through the oil introducing pipe (77).

Effects of the Invention

According to the present invention, redundant refrigerant is stored in the sub-circuit (70) which is separated from the main circuit (43) of the refrigerant circuit (40), and thus heat loss can be reduced. Specifically, during refrigeration operation, refrigerant continuously circulates in the main circuit (43) of the refrigerant circuit (40). Since refrigerant is stored in the sub-circuit (70) separated from this main circuit (43) in which refrigerant continuously circulates, heat dissipation of the continuously circulating refrigerant into the outside can be suppressed. As a result, heat loss can be reduced.

In the second and third aspects, refrigerant is stored in the refrigerant regulator (72) provided in the sub-circuit (70), thus ensuring adjustment of the amount of refrigerant in the main circuit (43).

In the fourth aspect, when an insufficient amount of refrigerant is contained in the main circuit (43), liquid refrigerant stored in the refrigerant regulator (72) is supplied to the main circuit (43), thus accurately adjusting the amount of refrigerant in the main circuit (43).

In the fifth and sixth aspects, excess and deficiency of the refrigerant is determined based on the degree of supercooling of the refrigerant, thus accurately adjusting the amount of refrigerant during normal operation such as refrigeration operation.

In the eighth and ninth aspects, redundant oil can be stored in the refrigerant regulator (72), thus preventing degradation of heat transmission performance of the heat exchanger caused by attachment of oil. In addition, since a single vessel can store both refrigerant and oil, the number of parts can be reduced.

DESCRIPTION OF CHARACTERS

Figure 1:
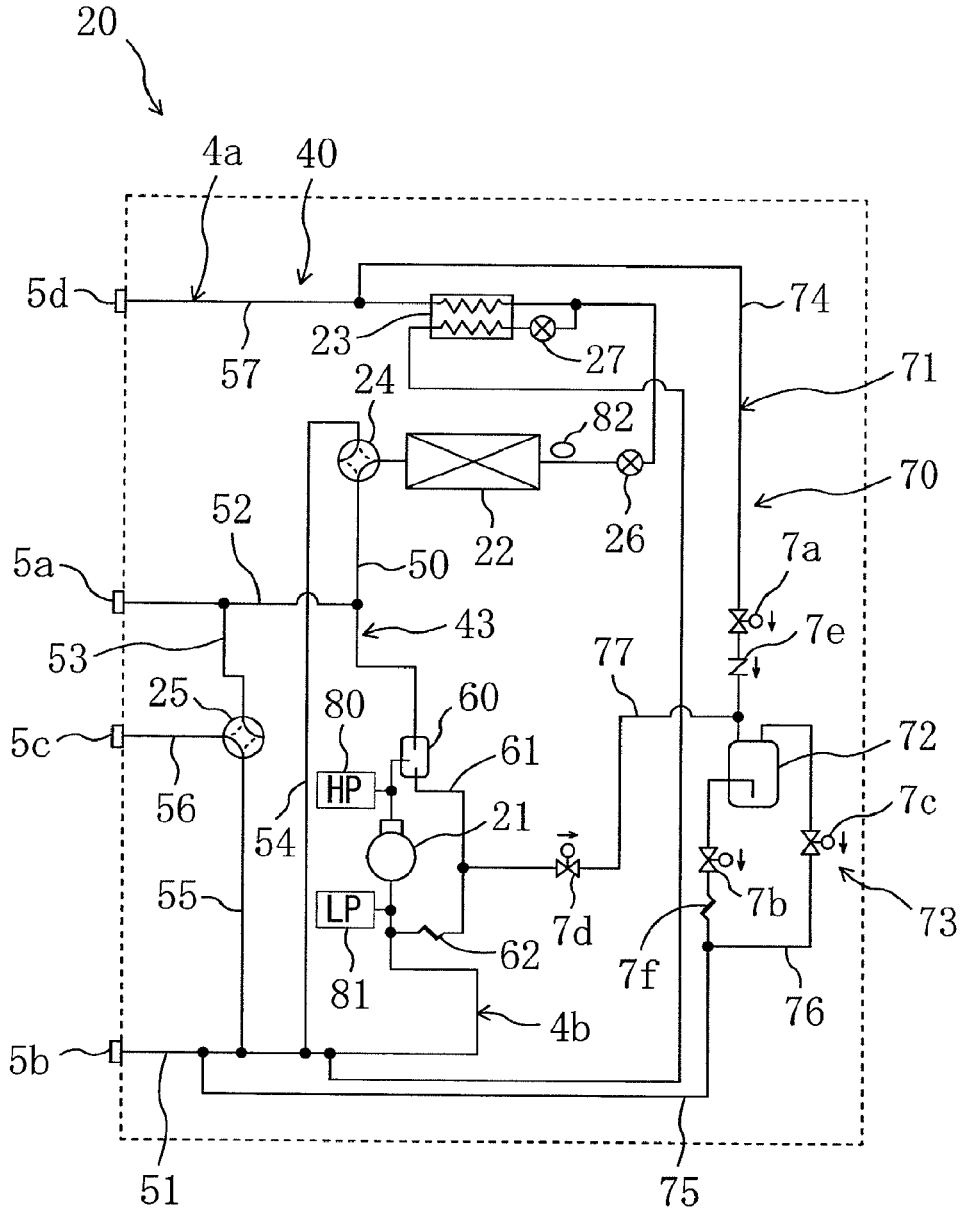
FIG. 1 is a circuit configuration diagram illustrating an outdoor unit according to a first embodiment.

10 air conditioner
20 outdoor unit (heat source unit)
21 compressor
22 outdoor heat exchanger (heat-source side heat exchanger)
30 indoor unit (utilization unit)
31 indoor heat exchanger (utilization side heat exchanger)
40 refrigerant circuit
43 main circuit
4*a* liquid line
4*b* low-pressure gas line
60 oil separator
61 oil return passageway
70 sub-circuit
71 sub-passageway
72 refrigerant regulator
73 switch mechanism
91 refrigerant-amount controlling part (refrigerant-amount controlling means)

BEST MODE FOR CARRYING OUT THE INVENTION

Hereinafter, embodiments of the present invention will be specifically described with reference to the drawings.

Embodiment 1

Figure 2:
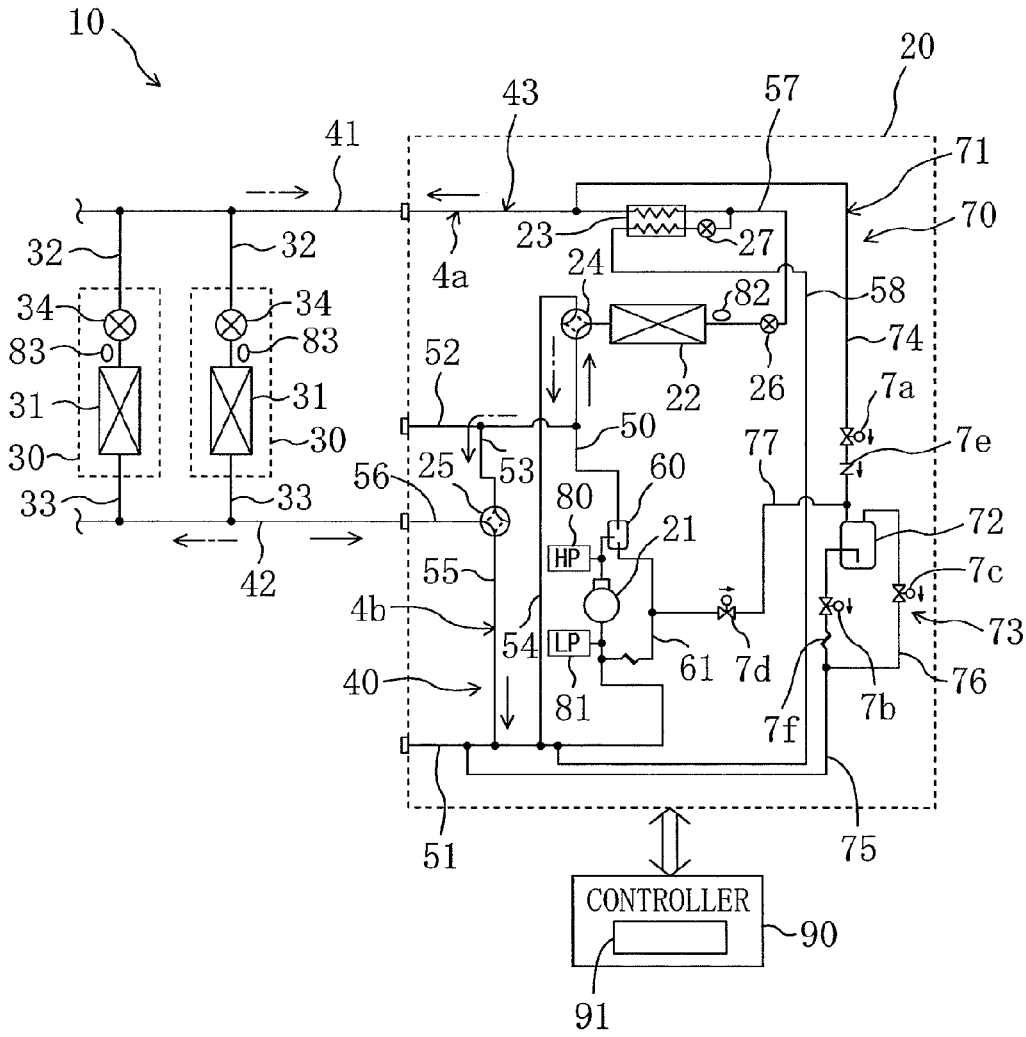
FIG. 2 is a circuit configuration diagram illustrating an air conditioner according to the first embodiment.

As illustrated in FIGS. 1 and 2, in a first embodiment, a refrigeration system according to the present invention is applied to a multi-type air conditioner (10). This air conditioner (10) includes: an outdoor unit (20) which is a heat source unit of the present invention; a plurality of indoor units (30) which are utilization units; and a refrigerant circuit (40) which is switchable between cooling operation and heating operation.

The outdoor unit (20) includes: a compressor (21); an outdoor heat exchanger (22) which is a heat-source side heat exchanger; a supercooling heat exchanger (23); a first selector valve (24); and a second selector valve (25).

The discharge side of the compressor (21) is connected to an end of a discharge pipe (50). The suction side of the compressor (21) is connected to an end of a low-pressure gas pipe (51). The discharge pipe (50) is connected to an end of the outdoor heat exchanger (22) through the first selector valve (24). An end of a high-pressure gas pipe (52) is connected to the discharge pipe (50), and the other end of the high-pressure gas pipe (52) is configured as a connection port (5*a*) which can be freely opened and closed. In this embodiment, the connection port (5*a*) of the high-pressure gas pipe (52) is closed.

An end of a high-pressure branch pipe (53) is connected to the high-pressure gas pipe (52), and the other end of the high-pressure branch pipe (53) is connected to the second selector valve (25).

The other end of the low-pressure gas pipe (51) is configured as a connection port (5*b*) which can be freely opened and closed. In this embodiment, the connection port (5*b*) of the low-pressure gas pipe (51) is closed. An end of a first low-pressure branch pipe (54) and an end of a second low-pressure branch pipe (55) are connected to the low-pressure gas pipe (51). The other end of the first low-pressure branch pipe (54) is connected to the first selector valve (24). The other end of the second low-pressure branch pipe (55) is connected to the second selector valve (25).

An end of a connection gas pipe (56) is connected to the second selector valve (25). The other end of the connection gas pipe (56) is configured as a connection port (5*c*) which can be freely opened and closed.

The first selector valve (24) and the second selector valve (25) are four-way selector valves in each of which one port is closed.

The first selector valve (24) is switchable between a position (i.e., a cooling operation position indicated by the solid lines in FIG. 2) in which the discharge pipe (50) communicates with the outdoor heat exchanger (22) and an end of the first low-pressure branch pipe (54) is closed, and a position (i.e., a heating operation position indicated by the broken lines in FIG. 2) in which an end of the discharge pipe (50) is closed and the first low-pressure branch pipe (54) communicates with the outdoor heat exchanger (22).

The second selector valve (25) is switchable between a position (i.e., a cooling operation position indicated by the solid lines in FIG. 2) in which an end of the high-pressure branch pipe (53) is closed and the connection gas pipe (56) communicates with the second low-pressure branch pipe (55), and a position (i.e., a heating operation position indicated by the broken lines in FIG. 2) in which the high-pressure branch pipe (53) communicates with the connection gas pipe (56) and an end of the second low-pressure branch pipe (55) is closed.

The other end of the outdoor heat exchanger (22) is connected to an end of a liquid pipe (57). The other end of the liquid pipe (57) is configured as a connection port (5*d*) which can be freely opened and closed. On the liquid pipe (57), an outdoor expansion valve (26) and the supercooling heat exchanger (23) are provided in order in the direction from the outdoor heat exchanger (22) toward the connection port (5*d*). The supercooling heat exchanger (23) is connected to a supercooling passageway (58). An end of the supercooling passageway (58) is connected between the outdoor expansion valve (26) and the supercooling heat exchanger (23), and is connected to a supercooling expansion valve (27) and the supercooling heat exchanger (23) in order. The other end of the supercooling passageway (58) is connected to the low-pressure gas pipe (51). The supercooling heat exchanger (23) is configured to divide part of liquid refrigerant flowing in the liquid pipe (57) to reduce the pressure thereof, thereby supercooling the liquid refrigerant flowing in the liquid pipe (57).

The discharge pipe (50) is provided with an oil separator (60). The oil separator (60) is connected to an end of an oil return passageway (61). This oil return passageway (61) is provided with a capillary tube (62). The other of the oil return passageway (61) is connected to a portion of the low-pressure gas pipe (51) toward the suction side of the compressor (21).

A liquid pipe (41) is connected to the connection port (5*d*) of the liquid pipe (57). A gas pipe (42) is connected to the connection port (5*d*) of the connection gas pipe (56).

The plurality of indoor units (30) are connected in parallel between the liquid pipe (41) and the gas pipe (42).

Each of the indoor units (30) includes an indoor heat exchanger (31) which is a utilization side heat exchanger. The liquid side of the indoor heat exchanger (31) is connected to the liquid pipe (41) through an indoor liquid pipe (32), and the gas side of the indoor heat exchanger (31) is connected to the gas pipe (42) through an indoor gas pipe (33). The indoor gas pipe (33) is provided with an indoor expansion valve (34).

The refrigerant circuit (40) includes a main circuit (43) for performing refrigerant circulation in which refrigerant discharged from the compressor (21) returns to the compressor (21) by way of the outdoor heat exchanger (22) and the indoor heat exchanger (31) in each of cooling operation and heating operation. Specifically, the main circuit (43) includes the compressor (21), the discharge pipe (50), the outdoor heat exchanger (22), the liquid pipe (57), the liquid pipe (41), the indoor liquid pipe (32), the indoor heat exchanger (31), the indoor gas pipe (33), the gas pipe (42), the connection gas pipe (56), the second low-pressure branch pipe (55), the low-pressure gas pipe (51), the high-pressure gas pipe (52), and the high-pressure branch pipe (53). The liquid pipe (57) and the liquid pipe (41) constitute a liquid line (4*a*). The gas pipe (42), the low-pressure gas pipe (51), the first low-pressure branch pipe (54) constitute a low-pressure gas line (4*b*).

On the other hand, the outdoor unit (20) includes a sub-circuit (70) which is a feature of the present invention. The sub-circuit (70) stores refrigerant in the main circuit (43), and includes a sub-passageway (71), a refrigerant regulator (72), a switch mechanism (73), and an oil introducing pipe (77). An end of the sub-passageway (71) is connected to the liquid pipe (57) as the liquid line (4*a*) at a location between the supercooling heat exchanger (23) and the connection port (5*d*), and the other end of the sub-passageway (71) is connected to the low-pressure gas pipe (51).

The refrigerant regulator (72) is configured as a sealed vessel capable of storing given liquid refrigerant. The top of the refrigerant regulator (72) is connected to a recovery pipe (74) of the sub-passageway (71), and the bottom of the refrigerant regulator (72) is connected to a return pipe (75) of the sub-passageway (71). The sub-passageway (71) is provided with a gas vent pipe (76). An end of the gas vent pipe (76) is connected to the top of the refrigerant regulator (72), and the other end of the gas vent pipe (76) is connected to the return pipe (75) of the sub-passageway (71).

The oil introducing pipe (77) is capable of establishing and blocking communication with the oil introducing pipe (77), and is configured to introduce, into the refrigerant regulator (72), part of oil returning from the oil separator (60) to the compressor (21). An end of the oil introducing pipe (77) is connected to the oil return passageway (61), and the other end of the oil introducing pipe (77) is connected to the refrigerant regulator (72).

The switch mechanism (73) is configured to establish and block communication between the refrigerant regulator (72) and each of the liquid line (4*a*) and the low-pressure gas line (4*b*), and includes a recovery valve (7*a*) provided on the recovery pipe (74) of the sub-passageway (71), a return valve (7*b*) provided on the return pipe (75), a gas vent valve (7*c*) provided on the gas vent pipe (76), and an introduction valve (7*d*) provided on the oil introducing pipe (77). The recovery pipe (74) is provided with a check valve (7*e*) which allows only the flow into the refrigerant regulator (72). The return pipe (75) is provided with a capillary tube (7*f*).

The discharge side of the compressor (21) is provided with a high-pressure pressure sensor (80) for detecting the pressure of high-pressure refrigerant. The suction side of the compressor (21) is provided with a low-pressure pressure sensor (81) for detecting the pressure of low-pressure refrigerant. The liquid side of the outdoor heat exchanger (22) is provided with an outdoor liquid-temperature sensor (82) for detecting the temperature of liquid refrigerant flowing from the outdoor heat exchanger (22). The liquid side of the indoor heat exchanger (31) is provided with an indoor liquid-temperature sensor (83) for detecting the temperature of liquid refrigerant flowing from the indoor heat exchanger (31).

Signals detected by the high-pressure pressure sensor (80), the low-pressure pressure sensor (81), the outdoor liquid-temperature sensor (82), and the indoor liquid-temperature sensor (83) are input to the controller (90).

The controller (90) controls cooling and heating operation, and is provided with a refrigerant-amount controlling part (91) which is a refrigerant-amount controlling means.

The refrigerant-amount controlling part (91) controls the switch mechanism (73) such that when the amount of refrigerant in the main circuit (43) is excessive, redundant refrigerant is stored in the refrigerant regulator (72), and that when the main circuit (43) is deficient in refrigerant, refrigerant in an amount corresponding to the deficiency is supplied from the refrigerant regulator (72) to the main circuit (43). In addition, the refrigerant-amount controlling part (91) is configured to determine whether the amount of refrigerant in the main circuit (43) is excessive or not and is insufficient or not, based on the degree of supercooling in one of the outdoor heat exchanger (22) or the indoor heat exchanger (31) which serves as a condenser.

Specifically, in cooling operation, the refrigerant-amount controlling part (91) derives the degree of supercooling from the saturation temperature corresponding to the high pressure based on the pressure detected by the high-pressure pressure sensor (80), and from the temperature detected by the outdoor liquid-temperature sensor (82). In heating operation, the refrigerant-amount controlling part (91) derives the degree of supercooling from the saturation temperature corresponding to the high pressure based on the pressure detected by the high-pressure pressure sensor (80), and from the temperature detected by the indoor liquid-temperature sensor (83).

When the degree of supercooling exceeds a value which has been set beforehand, the refrigerant-amount controlling part (91) opens the recovery valve (7*a*) and the gas vent valve (7*c*), thereby recovering liquid refrigerant in the main circuit (43) to the refrigerant regulator (72). When the degree of supercooling becomes smaller the set value, the refrigerant-amount controlling part (91) opens the return valve (7*b*), thereby supplying liquid refrigerant in the refrigerant regulator (72) to the main circuit (43).

When the compressor (21) is filled with a large amount of lubricating oil, the introduction valve (7*d*) and the gas vent valve (7*c*) are opened, thereby recovering oil in the main circuit (43) to the refrigerant regulator (72). Specifically, with respect to the outdoor unit (20) of this embodiment, only one outdoor unit (20) is not necessarily connected as shown in FIG. 2, and a plurality of outdoor units (20) may be connected in parallel. Thus, the compressor (21) is filled with oil in an amount sufficient for the case where a plurality of outdoor units (20) are connected and are used. Accordingly, in a case where the single outdoor unit (20) is connected, the amount of oil is excessive. Since the amount of oil in this case of using the single outdoor unit (20) is determined based on the amount of oil in the compressor (21), the introduction valve (7*d*) and the gas vent valve (7*c*) are opened for a given period of time to allow oil in the main circuit (43) to be recovered to the refrigerant regulator (72) when the amount of the lubricating oil is large.

When the amount of the recovered oil is excessive, the return valve (7*b*) is opened, thereby supplying the oil in the refrigerant regulator (72) to the main circuit (43).

—Operation—

Now, operation of the air conditioner (10) is described.

<Cooling Operation>

In cooling operation, the first selector valve (24) and the second selector valve (25) are switched to the solid-line positions, as indicated by the solid arrows in FIG. 2. In these positions, when the compressor (21) is operated, refrigerant circulates in the main circuit (43) of the refrigerant circuit (40).

Specifically, refrigerant discharged from the compressor (21) is condensed through heat exchange with the outdoor air in the outdoor heat exchanger (22). The condensed liquid refrigerant flows through the indoor units (30), and is reduced in pressure at the indoor expansion valves (34), and is subjected to heat exchange with the indoor air in the indoor heat exchangers (31) to evaporate. The gas refrigerant which has evaporated flows into the outdoor unit (20), and returns to the compressor (21). This refrigerant circulation is repeated, thereby cooling the room. In the supercooling heat exchanger (23), part of liquid refrigerant flowing in the liquid pipe (57) branches to the supercooling passageway (58), supercools liquid refrigerant flowing in the liquid pipe (57) through the supercooling expansion valve (27), and returns to the compressor (21).

<Heating Operation>

In heating operation, the first selector valve (24) and the second selector valve (25) are switched to the broken-line positions, as indicated by the dash-dotted arrows in FIG. 2. In these positions, when the compressor (21) is operated, refrigerant circulates in the main circuit (43) of the refrigerant circuit (40).

Specifically, refrigerant discharged from the compressor (21) flows through the indoor units (30), and is condensed through heat exchange with the indoor air in the indoor heat exchangers (31). The condensed liquid refrigerant flows through the outdoor unit (20), is reduced in pressure at the outdoor expansion valve (26), and then is subjected to heat exchange with the outdoor air in the outdoor heat exchanger (22) to evaporate. The gas refrigerant which has evaporated returns to the compressor (21). This refrigerant circulation is repeated, thereby heating the room. In the supercooling heat exchanger (23), part of liquid refrigerant flowing in the liquid pipe (57) branches to the supercooling passageway (58), supercools liquid refrigerant flowing in the liquid pipe (57) through the supercooling expansion valve (27), and returns to the compressor (21).

<Functions of Sub-Circuit (70)>

In the cooling and heating operation, when a large amount of refrigerant is contained in the main circuit (43), redundant refrigerant is recovered to the sub-circuit (70) based the degree of supercooling.

Specifically, in the cooling operation, the refrigerant-amount controlling part (91) derives the degree of supercooling of refrigerant in the outdoor heat exchanger (22), based on the pressure of high-pressure refrigerant in the high-pressure pressure sensor (80) and the temperature of liquid refrigerant in the outdoor liquid-temperature sensor (82). In the heating operation, the refrigerant-amount controlling part (91) derives the degree of supercooling of refrigerant in the indoor heat exchangers (31), based on the pressure of high-pressure refrigerant in the high-pressure pressure sensor (80) and the temperature of liquid refrigerant in the indoor liquid-temperature sensors (83).

When the degree of supercooling exceeds a value which has been set beforehand, the refrigerant-amount controlling part (91) opens the recovery valve (7*a*) and the gas vent valve (7*c*), thereby recovering liquid refrigerant in the main circuit (43) to the refrigerant regulator (72). At this time, the return valve (7*b*) and the introduction valve (7*d*) are closed.

On the other hand, when the degree of supercooling becomes smaller than the set value, the refrigerant-amount controlling part (91) opens the return valve (7*b*), thereby supplying liquid refrigerant in the refrigerant regulator (72) to the main circuit (43). At this time, the recovery valve (7*a*), the gas vent valve (7*c*), and the introduction valve (7*d*) are closed.

When the compressor (21) is filled with a large amount of lubricating oil, the introduction valve (7*d*) and the gas vent valve (7*c*) are opened, thereby recovering oil in the main circuit (43) to the refrigerant regulator (72). Specifically, oil is discharged together with refrigerant discharged from the compressor (21), and the discharged oil returns from the oil separator (60) to the compressor (21) through the oil return passageway (61). The oil which has returned from the oil separator (60) is recovered to the refrigerant regulator (72). At this time, the recovery valve (7*a*) and the return valve (7*b*) are closed. When an excessively large amount of oil is recovered, the return valve (7*b*) is opened, thereby supplying the oil in the refrigerant regulator (72) to the main circuit (43). At this time, the recovery valve (7*a*), the gas vent valve (7*c*), and the introduction valve (7*d*) are closed.

—Advantages of Embodiment 1—

As described above, in this embodiment, redundant refrigerant is stored in the sub-circuit (70) separated from the main circuit (43) of the refrigerant circuit (40), and thus heat loss can be reduced. Specifically, in air conditioning operation such as cooling or heating operation, refrigerant continuously circulates in the main circuit (43) of the refrigerant circuit (40). Refrigerant is stored in the sub-circuit (70) separated from the main circuit (43) in which the refrigerant continuously circulates. Since the refrigerant does not continuously circulate in the sub-circuit (70), heat dissipation from the continuously circulating refrigerant into the outside can be suppressed. As a result, heat loss can be reduced.

In addition, the refrigerant regulator (72) in the sub-circuit (70) is configured to store refrigerant, thus ensuring adjustment of the amount of refrigerant in the main circuit (43).

Further, when the main circuit (43) is deficient in refrigerant, liquid refrigerant stored in the refrigerant regulator (72) is supplied to the main circuit (43). Thus, the amount of refrigerant in the main circuit (43) can be accurately adjusted.

Moreover, excess and deficiency of refrigerant is determined based on the degree of supercooling. Thus, the amount of refrigerant during normal operation such as cooling or heating operation can be accurately determined.

Furthermore, redundant oil can be stored in the refrigerant regulator (72), and thus preventing degradation of heat transmission performance of the heat exchanger caused by attachment of oil. In addition, since a single vessel can store both refrigerant and oil, the number of parts can be reduced.

Embodiment 2

Figure 3:
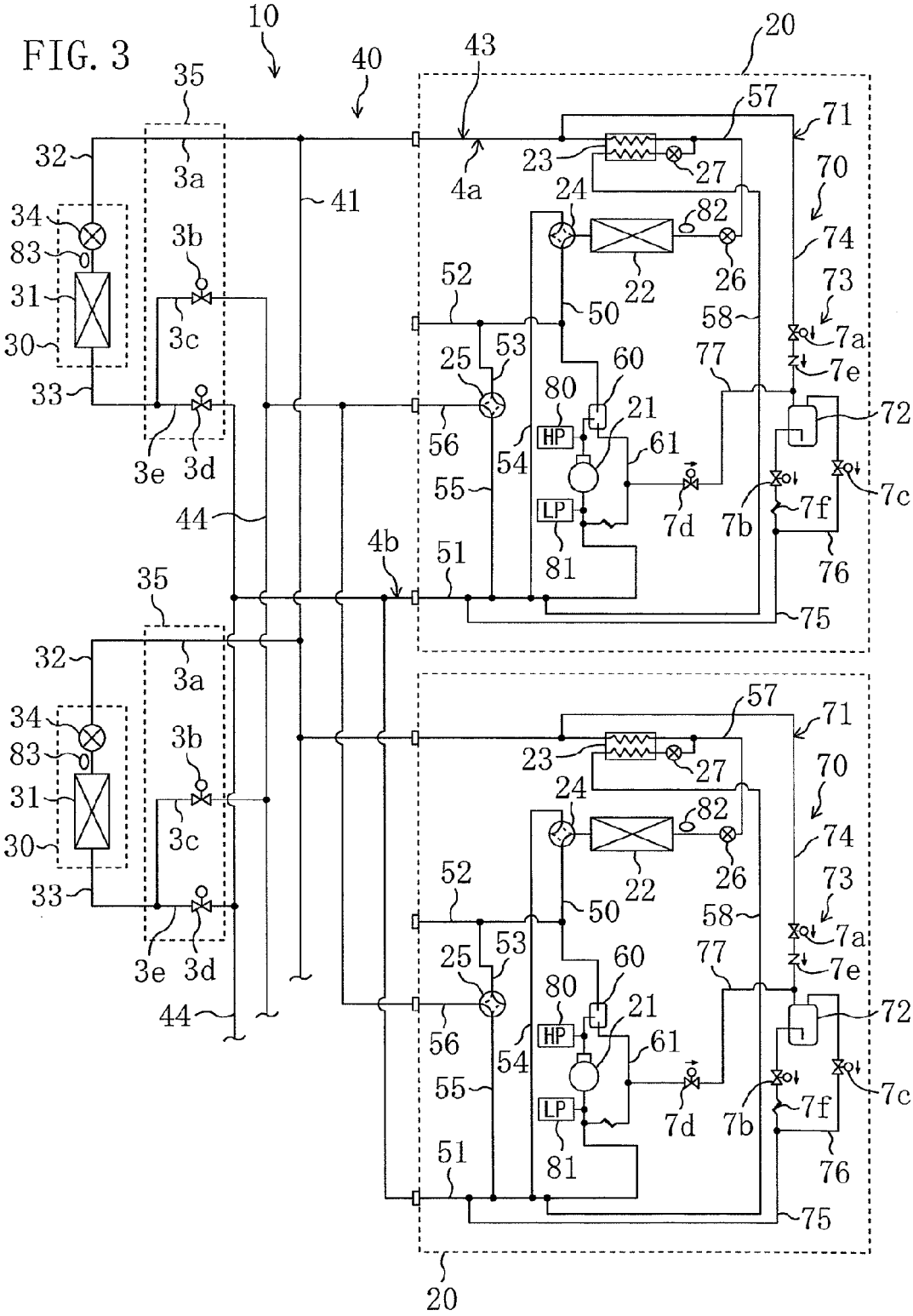
FIG. 3 is a circuit configuration diagram illustrating an air conditioner according to a second embodiment.

As illustrated in FIG. 3, in a second embodiment, unlike the first embodiment employing the single outdoor unit (20), two outdoor units (20) are provided, and cooling operation and heating operation of the indoor units (30) are performed at a time. The gas pipe (42) of the first embodiment is replaced by a high-pressure gas pipe (44) and a low-pressure gas pipe (45).

Specifically, the outdoor units (20) are parallel to each other. Connection gas pipes (56) of the outdoor units (20) are connected to the high-pressure gas pipe (44). Low-pressure gas pipes (51) of the outdoor units (20) are connected to the low-pressure gas pipe (45). Liquid pipes (57) of the outdoor units (20) are connected to a liquid pipe (41).

On the other hand, each of the indoor units (30) is connected to the high-pressure gas pipe (44), the low-pressure gas pipe (45), and the liquid pipe (41) through a branch unit (35) which is a BS unit. That is, indoor liquid pipes (32) of the indoor units (30) are connected to the liquid pipe (41). Indoor gas pipes (33) of the indoor units (30) are connected to be switchable between the high-pressure gas pipe (44) and the low-pressure gas pipe (45).

Each of the branch units (35) includes: a liquid pipe (3*a*); a high-pressure gas pipe (3*c*) with a high-pressure valve (3*b*); and a low-pressure gas pipe (3*d*) with a low-pressure valve (3*d*). Each of the indoor units (30) opens the high-pressure valve (3*b*) and closes the low-pressure valve (3*d*) during heating operation. Each of the indoor units (30) opens the low-pressure valve (3*d*) and closes the high-pressure valve (3*b*) during cooling operation. Through this operation, cooling or heating operation is performed by the indoor units (30).

Configurations, operation, and advantages of the other components such as sub-circuits (70) are the same as those in the first embodiment.

Other Embodiments

The foregoing embodiments of the present invention may be changed as follows.

The foregoing embodiments are directed to the air conditioners (10). Alternatively, the present invention may be directed only to heat source units which are the outdoor units (20).

In the first and second embodiments, the refrigerant-amount controlling part (91) as the refrigerant-amount controlling means determines excess and deficiency in the main circuit (43), based on the degree of supercooling. Alternatively, excess and deficiency of refrigerant may be determined based on a change in the pressure of refrigerant discharged from the compressor (21). More specifically, when the amount of refrigerant in the main circuit (43) is excessive, the pressure of refrigerant discharged from the compressor (21) after start-up greatly increases. In view of this, the refrigerant-amount controlling part (91) may derive a change in the pressure of refrigerant discharged from the compressor (21) after start-up from the pressure detected by the high-pressure pressure sensor, and to determine the excess and deficiency in the main circuit (43) based on this change.

Components such as the recovery valve (7*a*) of the sub-circuit (70) are not limited to those of the first and second embodiments.

The outdoor unit (20) may be connected to an auxiliary heat exchange unit. Specifically, an auxiliary heat exchanger of the auxiliary heat exchange unit may be connected to the high-pressure gas pipe (52), the connection gas pipe (56), and the low-pressure gas pipe (51). This auxiliary heat exchange unit may be used for compensating for condensation performance and evaporation performance of the outdoor unit (20).

In the second embodiment, three or more outdoor units (20) may be provided, of course.

The foregoing embodiments are merely preferred examples in nature, and are not intended to limit the scope, applications, and use of the invention.

INDUSTRIAL APPLICABILITY

As described above, the present invention is useful for heat source units including compressors and heat-source side heat exchangers, and for refrigeration systems including such heat source units.

The invention claimed is:

1. A refrigeration system comprising:

a heat source unit, said heat source unit comprising:

a compressor to which a low-pressure gas line is connected;

a heat-source side heat exchanger whose one end communicates with the compressor and another end is connected to a liquid line; and a sub-circuit whose one end is connected to the liquid line and another end is connected to the low-pressure gas line, wherein the compressor, the low-pressure gas line, the heat-source side heat exchanger, and the liquid line constitute a portion of a main circuit of a refrigerant circuit, the sub-circuit is separated from the main circuit, and stores refrigerant in the main circuit, the sub-circuit includes:

a sub-passageway whose one end is connected to the liquid line and another end is connected to the low-pressure gas line;

a refrigerant regulator provided on the sub-passageway and storing refrigerant in the main circuit; and a switch mechanism configured to establish and block communication between the refrigerant regulator and each of the liquid line and the low-pressure gas line, the main circuit of the refrigerant circuit is configured by connecting a utilization unit including a utilization side heat exchanger to the heat source unit, the refrigeration system includes a refrigerant-amount controlling device configured to control the switch mechanism such that when an amount of refrigerant in the main circuit is excessive, redundant refrigerant in the main circuit is stored in the refrigerant regulator, and the refrigerant-amount controlling device being configured to determine whether an amount of refrigerant in the main circuit is excessive or not, based on a degree of supercooling in one of the heat-source side heat exchanger and the utilization side heat exchanger which serves as a condenser.

2. The refrigeration system of claim 1, wherein the refrigerant-amount controlling device controls the switch mechanism such that when the main circuit is deficient in refrigerant, refrigerant in an amount corresponding to the deficiency is supplied from the refrigerant regulator to the main circuit.

3. The refrigeration system of claim 1, wherein the refrigerant-amount controlling device is configured to determine whether the main circuit is deficient in refrigerant or not, based on a degree of supercooling in one of the heat-source side heat exchanger and the utilization side heat exchanger which serves as a condenser.

4. The refrigeration system of claim 1, further comprising:

an oil separator provided at a discharge side of the compressor;

an oil return passageway for returning oil in the oil separator to the compressor; and an oil introducing pipe connecting the oil return passageway and the refrigerant regulator to each other, and capable of establishing and blocking communication with the oil introducing pipe.

* * * * *